United States Patent [19]

Ganz

[11] 4,200,220

[45] Apr. 29, 1980

[54] WRAP-AROUND PAPERBOARD CARRIER WITH LATCHING AND LOCKING PANELS

[75] Inventor: Robert H. Ganz, Saddle River, N.J.

[73] Assignee: Federal Paper Board Co., Inc., Montvale, N.J.

[21] Appl. No.: 955,312

[22] Filed: Oct. 27, 1978

[51] Int. Cl.[2] ..... B65D 5/04

[52] U.S. Cl. ..... 229/40; 206/140

[58] Field of Search ..... 229/40; 206/140

[56] References Cited

U.S. PATENT DOCUMENTS

| | | | |
|---|---|---|---|
| 3,014,636 | 12/1961 | Fielding | 229/40 X |
| 3,152,695 | 10/1964 | Stewart, Jr. | 229/40 X |
| 3,194,476 | 7/1965 | Weiss | 206/140 X |
| 3,381,881 | 5/1968 | Ganz et al. | 229/40 |
| 3,456,420 | 7/1969 | Ganz | 229/40 X |
| 3,589,593 | 6/1971 | Weiss | 229/40 |

*Primary Examiner*—Davis T. Moorhead

*Attorney, Agent, or Firm*—Fitzgibbon, Roehrig, Greenawalt & Gilhooly

[57] ABSTRACT

A system for packaging cans or similar articles which is characterized by a wrap-around style blank of paperboard, or other suitable sheet material, which is cut and scored to divide it into wall forming panels adapted to be wrapped about a row of the articles, so as to form an open ended tubular carton, with the blank having hinged terminal end panels in the form of narrow strips which are interleaved and secured so as to cooperate with adjoining panel portions in forming one of the carton walls, the end panels being seated by a hinging movement which draws the panels into tight wrap formation and which engages primary locking tabs on the terminal edge of the one end panel in cooperating locking apertures disposed at the hinge line of the other end panel while hinged secondary locking tabs which are cut from the material adjacent the hinge line of the one end panel are engaged in cooperating locking apertures which are cut in the material of the wall panel to which the other end panel is hingedly connected.

5 Claims, 6 Drawing Figures

WRAP-AROUND PAPERBOARD CARRIER WITH LATCHING AND LOCKING PANELS

BACKGROUND OF THE INVENTION

In the packaging of canned or bottled beverages and products of a similar nature for marketing in retail stores or other consumer supply centers, one type of packaging system which has had a high degree of acceptability by both the consumers and the suppliers has been the multi-unit packaging system wherein a wrap-around blank is folded about the desired number of cans, bottles or similar articles positioned in row formation with terminal end portions of the blank secured so as to form a tightly wrapped package. In the multi-unit packaging systems of this type which have been developed, one of the problems has been how best to obtain a tightly wrapped package so that the product units will be restrained against falling out of the package when it is handled. Many arrangements have been suggested for retaining the product units against accidental disengagement from the wrapper. In most of the systems which have been employed, pockets formed in the blank, in which portions of the product containers are seated, have been relied upon, solely or in part, to retain the product containers in the tubular carton which is formed by wrapping the blank about the assembly of the same. To be fully effective, provision must be made, in such systems, for connecting the terminal ends of the blank while the product enclosing panels are tightly drawn about the assembly. This has proven difficult of solution, particularly when there is a need to satisfy the demand for high speed machine production. Securing the end panels by an adhesive cannot be accomplished with sufficient speed because of the time required for applying or activating and setting the adhesive. The use of an adhesive does not provide a satisfactory securing means for other well recognized reasons. While the employment of wrapper blanks having interlocking securing elements on overlapped end portions of the end panels which can be quickly engaged on automatic machinery so as to obtain a glueless wrapper or carton enables package forming on automatic machinery which is operable at high speeds, generally this type blank has required means in the machine for applying compressive force along one or both sides of the path traversed by the assembly so as to hold the latch bearing panels in position while the latching and locking elements are engaged. Typical packaging systems of this type are shown in my U.S. Pat. No. Re. 26,750, granted Jan. 6, 1970, and U.S. Pat. Nos. 3,194,476 and No. 3,589,593, granted to A. J. Weiss on July 13, 1965, and June 29, 1971, respectively. The employment of this type package has resulted in the need for relatively expensive machine designs which will provide the tightening forces needed and the mechanism for the manipulation of the locking and latching elements in a manner which will insure that these elements will not separate accidentally during the handling of the packages. Machines for this purpose are disclosed in my U.S. Pat. No. 3,085,377, granted Apr. 16, 1963, No. 3,456,420, granted July 22, 1969, and No. 3,474,590, granted Oct. 28, 1969. While these prior systems have formed the basis for successful commercial operations, there is a need for the development of a packaging system for articles of the type described which will employ a simplified blank structure, which will provide a tightly wrapped package and which will enable the package to be formed on high speed packaging machinery of more economical design than currently available.

It is a general object of the present invention to provide a package and a method of forming the same which is particularly adapted for multi-unit packaging of canned or bottled beverages or other products in containers of the same or similar configuration, which is economical of material, which satisfies the requirements for a tightly wrapped package, which will afford a high degree of safety under normal handling, and which lends itself to high speed wrapping operations on automatic machinery of relatively simple and economical design.

It is a more specific object of the invention to provide an improved package and method of forming the same which is adaptable to the packaging of a group of articles, such as, cans or similar containers for beverages, or the like, wherein the articles are arranged in row relation and enclosed in a foldable wrapper blank which is cut and scored so as to permit it to be wrapped, about the top, bottom and sides of the articles, in the form of a tube, and secured in tight relation by folding upon each other relatively narrow terminal panels having associated locking and latching tab members which are engaged in cooperating locking and latching apertures in portions of the adjoining wall forming panels.

It is a still more specific object of the invention to provide a packaging system for multiple unit packaging of beverage cans, or the like, wherein the cans are arranged in row forming relation and enclosed in a tubular carton formed by a tightly wrapped, generally rectangular blank of paperboard or similar foldable sheet material which includes tightening and securing means on the terminal ends in the form of relatively narrow hinged strips of the blank material, which hinged strips are so proportioned relative to the adjoining wall forming panel portions that they may be interleaved and hinged into panel securing position in the plane of the adjoining wall forming panel portions while drawing the adjoining panel portions toward each other to form a tightly wrapped package.

Another object of the invention is to provide a wrapper forming blank and a method of applying the same to an assembly of articles having the general form of beverage containers, so as to enclose the articles therein and form a tubular carton wherein the terminal ends of the blank are in the form of relatively narrow hinged panels which are proportioned and interleaved in reversely folded relation with a free edge portion of one hinged panel positioned in engaging relation with a panel portion adjacent the hinge line of the other hinged panel whereby to form a hinge pivot for drawing the adjoining panel portions toward each other when the hinge panels are folded relative to each other into the plane of the adjoining panel portions and secured thereto so as to form a tightly wrapped package.

A further object of the invention is to provide a wrapper forming blank and a method of applying the same to an assembly of articles, such as beverage containers, so as to enclose the articles in a tubular carton wherein the terminal ends of the blank are in the form of relatively narrow hinged panels which are proportioned so as to draw the adjoining panel portions toward each other when they are reversely folded on each other into interleaved relation in the plane of the adjoining portions so as to form therewith a carton wall and wherein the one hinged panel has associated locking and latching tab members adjacent its opposite edges which are seated in cooperating locking and latching apertures provided in associated wall forming panel portions.

To this end the invention as disclosed and claimed herein comprises a package and a method of forming the same wherein beverage cans or similar articles are enclosed in an open ended carton by wrapping a cut and scored blank about an assembly of the articles and connecting the ends of the blank, with relatively narrow end panel portions of the blank hinging upon each other into interleaved relation between end portions of the adjoining panel portions in a manner which draws the panel portions toward each other so as to result in a tightly wrapped package.

The aforesaid objects and other objects and advantages of the invention will become more apparent when reference is made to the accompanying detailed description of the preferred embodiment of the invention which is set forth therein, by way of example, and shown in the accompanying drawings wherein like reference numerals indicate corresponding parts throughout.

DESCRIPTION OF THE PREFERRED EMBODIMENTS OF THE INVENTION

Figure 1:
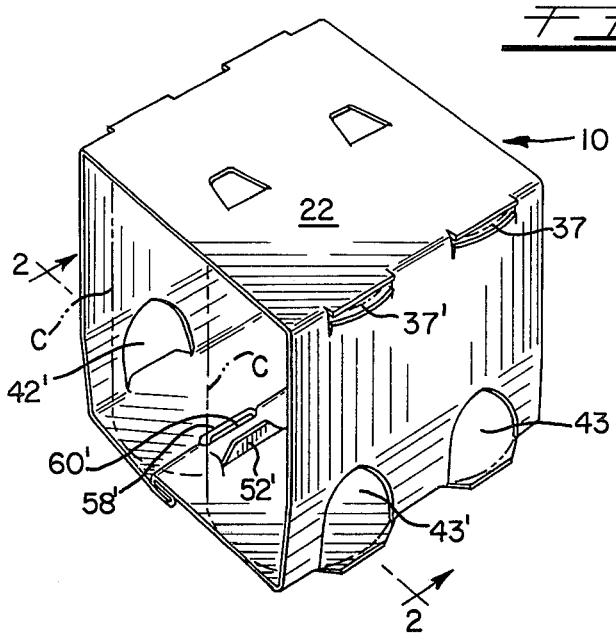
FIG. 1 is a perspective view of a package of beverage cans which embodies therein the principal features of the invention, the cans being shown in phantom line.

Referring to the drawings, there is illustrated a package 10 (FIG. 1) and a method of forming the same which embodies the principal features of the invention. The illustrated package comprises an assembly of four beverage cans C enclosed in an open ended tubular carton which is formed by wrapping about the cans, while the cans are grouped in double row, transversely aligned pairs, a cut and scored blank 12 (FIG. 4) of paperboard, or similar foldable sheet material, and securing the ends of the blank in a manner which results in the carton walls being tightly drawn about the group of cans so as to form a tightly wrapped package and insure that the cans will be retained in the carton under normal handling of the package. It will be understood that the principles of the invention may be otherwise applied, and that the following description of the package and the method of forming the same is for the purpose of setting forth the form of the invention which is presently preferred.

Figure 3:
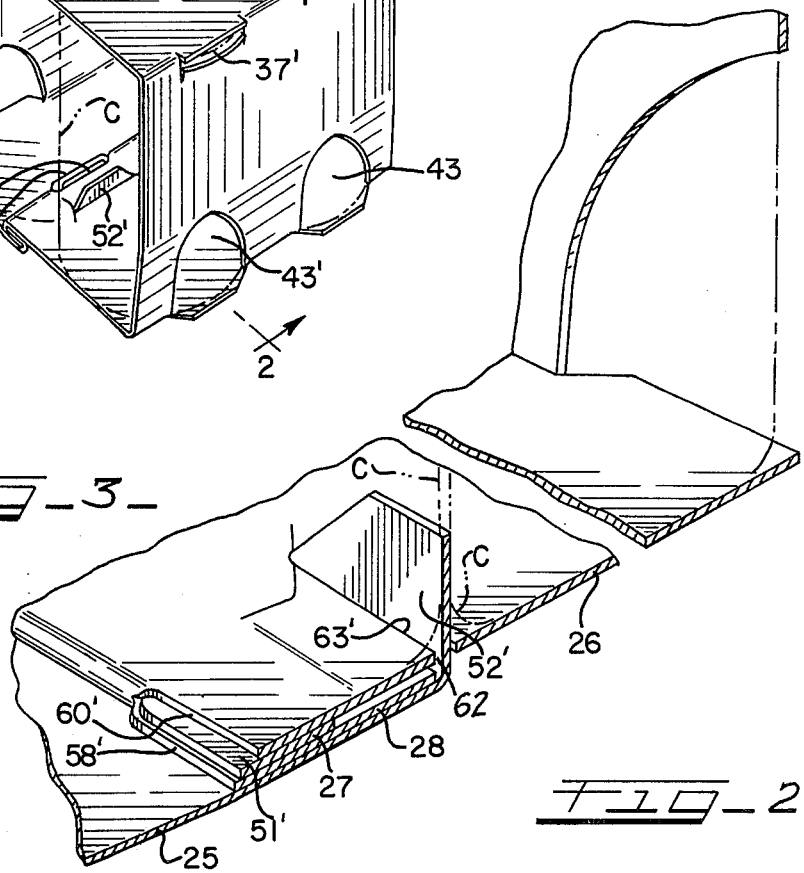
FIG. 3 is a sectional view in perspective and to an enlarged scale, the view being taken through the bottom portion of the package, on the line 2—2 of FIG. 1.
Figure 2:
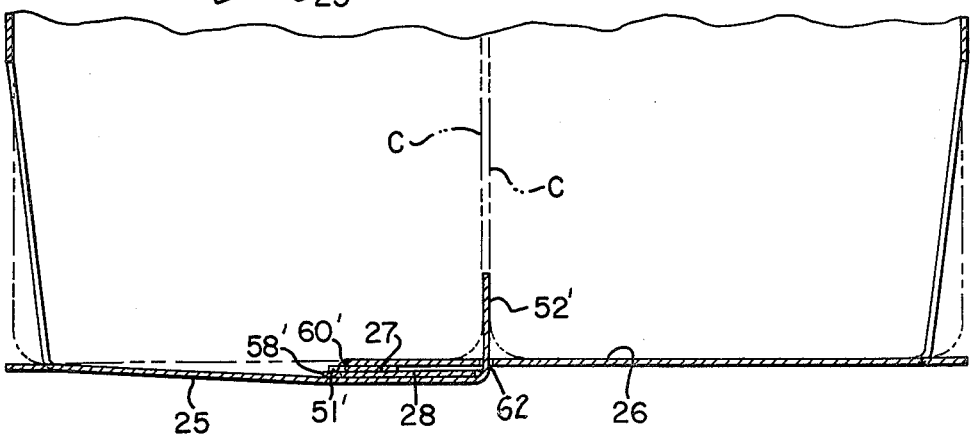
FIG. 2 is a vertical cross sectional view taken on the line 2—2 of FIG. 1 to an enlarged scale, and with portions broken away.
Figure 4:
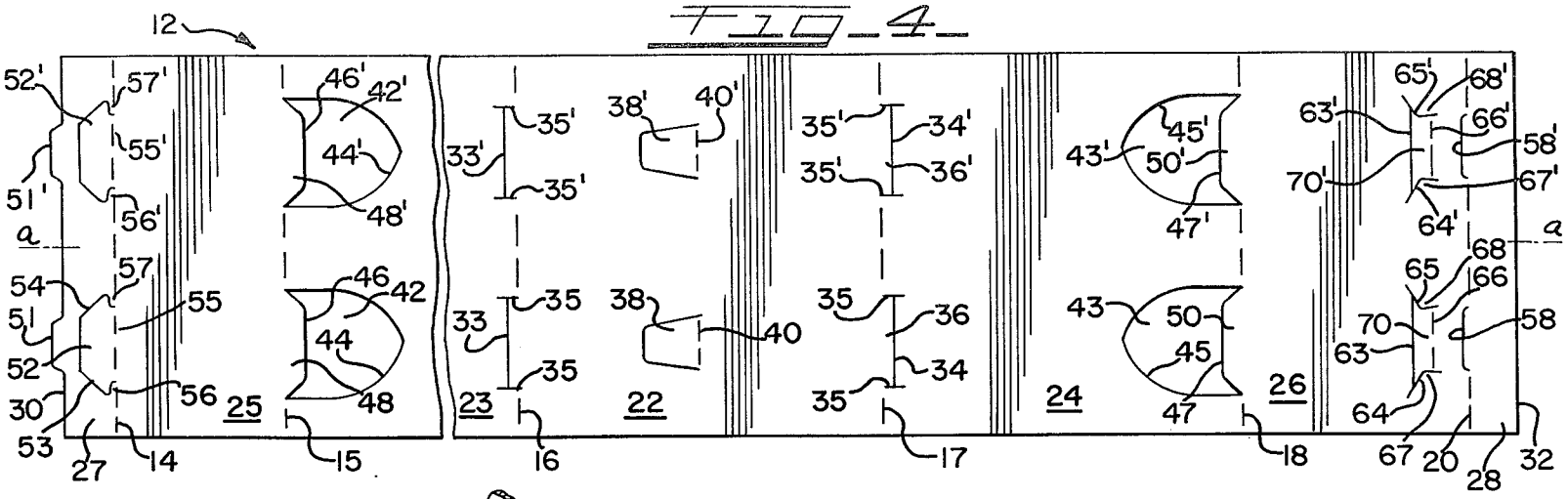
FIG. 4 is a plan view of a blank of paperboard which is cut and scored preparatory to forming the package of FIG. 1.
Figure 6:
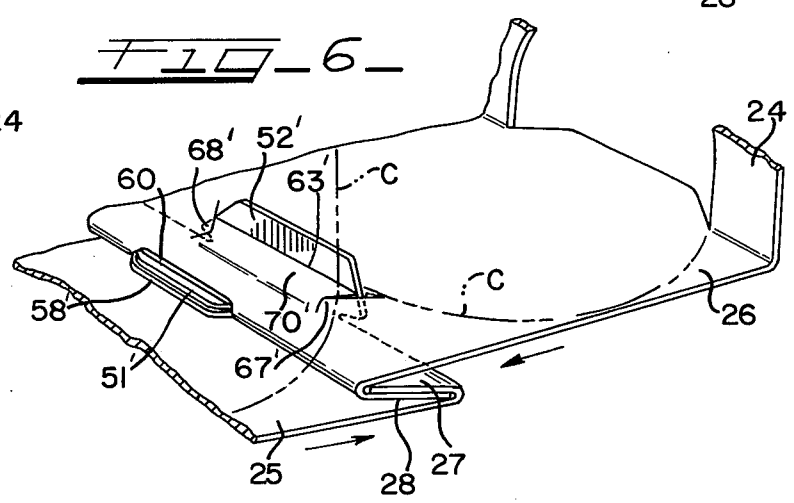
FIG. 6 is a further view in perspective illustrating subsequent folding, locking and latching operations.

The package structure 10 which is illustrated in FIGS. 1 to 3, is formed by wrapping the blank 12 of FIG. 4 about the group, assembly, or cluster of four beverage cans C which are arranged in double row and in transversely paired alignment, and securing the ends of the blank while the bottom wall forming panels are drawn inwardly of the sidewall forming panels by the folding operations. The cans C, as indicated in phantom line, are of well-known configuration. It will be understood that the blank may be modified to adapt it to the packaging of beverage bottles and other articles of the same or similar configuration.

The blank 12 is an elongate rectangular sheet of paperboard, or other foldable sheet material, which is of suitable weight or gauge and which is cut and scored as shown in FIG. 4. The blank of FIG. 4 is cut and scored so that it is symmetrical about a longitudinal center line a—a running intermediate its side edges. It is divided by longitudinally spaced hinge forming score lines 14, 15, 16, 17, 18 and 20 which extend in parallel relation transversely of the blank, and divide it into a top wall forming center panel section 22, adjoining sidewall forming panel sections 23, 24 and bottom wall forming end panel sections 25, 26, the latter having at their terminal end portions end panel connecting strips or locking and latching strips 27, 28 of relatively narrow width, the inner edges of which are defined by the hinge score lines 14 and 20, respectively. The panel connecting strips 27, 28, as shown, have substantially equal width, that is, equal dimensions in the direction longitudinally of the blank, and the hinge score lines are located inwardly of the end edges 30, 32 of the blank substantially the same distance. The hinge score lines 14 and 20 are located a predetermined distance from the corner forming hinge score lines 15 and 18, respectively, which distance is determined by the diameter dimensions of the can end faces which are engaged by the bottom wall forming panel sections 25 and 26 when the blank 12 is wrapped about the group or assembly of cans C.

The wall forming panels 22, 23, 24, 25 and 26 are cut and scored to provide identical can retention openings for each pair of the cans which are in alignment, longitudinally of the blank, on opposite sides of the longitudinal center line a—a. Also, aligned with the openings there are provided locking and latching elements which are engageable by manipulation of the bottom wall panel connecting strip or panel members 27 and 28. Since the can retention means and the locking and latching means on opposite sides of the center line a—a are of the same construction, the elements on one side of center line a—a which are identical with corresponding elements on the other side thereof, will be identified by the same numerals primed.

The transverse hinge score lines 16 and 17 which define corner forming edges of the top wall forming panel 22 are spaced apart in the longitudinal direction of the blank 12 a distance which is less than the combined diametrical dimension of the pair of cans C and are interrupted by pairs of transversely spaced, cutting lines 33, 33′ and 34, 34′ which are spaced transversely of the blank, so as to align with the cans, and which are offset relative to the score lines 16 and 17 in the direction of the ends of the blank, with each pair 33, 34 and 33′, 34′ spaced apart, in the longitudinal direction of the blank, a distance approximately equal to the combined diametrical dimension of the end faces of the associated pair of cans C. Each of the cutting lines 33, 33′ and 34, 34′ terminates at its opposite ends, in an identical manner, at a short cutting line 35, 35′ which extends lengthwise of the blank and straddles the associated transverse cutting line, so as to provide a short extension tab 36, 36′ on the panel 22 and a retention opening 37, 37′ (FIG. 1) when the panels are hinged to carton forming position in which a portion of each can chime will be seated. A pair of can separator tabs 38, 38', of relatively small dimensions, which are aligned with the cans and which hinge on score lines 40, 40', extending transversely of the blank, are cut in the panel 22 for swinging into a plane normal to the plane of the panel 22 so as to form a separator between the top portions of each pair of transversely aligned cans.

The sidewall forming panels 23 and 24 are cut in an identical manner to provide pairs of transversely spaced can retention openings 42, 42' and 43, 43' at the hinge forming score lines 15 and 18, the latter defining the bottom side edges of the can enclosing tubular carton when it is formed. The distance between the hinge lines 15, 16 and 17, 18 will correspond to the height or vertical dimension of the cans C. The openings 42, 42' and 43, 43' are formed in an identical manner and each pair thereof is spaced transversely of the blank so as to align with the cans. These openings are formed by cutting on generally C-shaped lines 44, 44' and 45, 45' which are bowed in the direction of the center of the blank with the ends terminating at the score lines 15 and 18, and at the ends of transverse cutting lines 46, 46' and 47, 47' which may be in the form shown or in the form of circular segments corresponding to the curvature of the can chimes beneath which the projecting tab formations 48, 48' and 50, 50', thus formed, will extend in can edge supporting relation.

The two end sections or panel portions 25 and 26 which extend from the score lines 15 and 18, respectively, are of different longitudinal dimensions and are subdivided by the hinge score lines 14 and 20 to provide the relatively narrow terminal end panels 27 and 28 which are utilized in forming the package to draw the panels into tight engagement about the assembly of cans and to be interleaved and locked in a common plane with the adjoining panel portions so as to cooperate therewith in forming the bottom wall of the can enclosing carton formation, as hereinafter described.

The wall forming panel section 25 has a dimension between the score lines 14 and 15 which is somewhat less than the diameter of a can while the dimension of the terminal end panel 27 in the same direction of the blank may vary but is determined so that it may be conveniently handled or manipulated, as hereinafter described, depending to some extent on the strength and stiffness of the blank material. The terminal end panel 27 is divided from the bottom wall forming panel section 25 by the transverse hinge score line 14 and is provided with sets or pairs of locking and latching elements, 51, 52 and 51', 52', each set of which includes cooperating tab elements, which may be termed primary and secondary locking elements. Primary locking tab elements 51, 51' are spaced along the transverse terminal edge 30 of the blank and each has a cooperating secondary locking or latching tab element 52, 52' associated with it. Each of the locking elements 51, 51' projects only a short distance outboard of the blank terminal edge 30 and is of a size to interengage in cooperating locking apertures hereinafter referred to. The secondary locking or latching tab elements 52, 52' are cut in the panel 27 so as to hinge on portions 55, 55' of the cross score line 14. These tab elements 52, 52' may be cut so as to have the general configuration shown in Weiss U.S. Pat. No. 3,589,593. Each of these has a truncated cone configuration with lateral edges cut on lines 53, 54 and 53', 54' diverging in the direction of the remote end of the blank 12 and terminating short of the hinge score line portions 55 and 55' with extensions thereof connecting to the ends of hinge score lines 55, 55' which extensions are inwardly directed toward each other so as to form slots or pockets 56, 57 and 56', 57' and provide abutment shoulders at the ends of the tab edges 53, 54 and 53', 54', which face in the direction of the hinge score lines 55, 55'.

The terminal end panel 28 at the opposite end of the blank 12 has a width or dimension in the lengthwise direction of the blank from cross score line 20 to the end edge 32 which is substantially the same as the dimension from score line 14 to the blank end edge 30. The cross score line 20 is interrupted by transversely spaced cutting lines 58, 58' which have approximately the configuration of the cutting lines defining the outboard edges of the locking tab elements 51, 51' and which are aligned, longitudinally of the blank, with tab elements 51, 51', so as to define cooperating locking apertures indicated at 60 in FIGS. 1 to 3, 5, and 6, for receiving the tabs 51, 51' upon folding of the panel 28 on the score line 20.

The panel section 26 is provided with latching elements, in the form of apertures 62, 62', (FIGS. 3 and 6) which are disposed for cooperation with the secondary locking or latching tabs 52, 52' when the panels are interleaved between adjoining portions of the panel sections 25, 26, which apertures 62, 62' are derived by cutting on the transversely spaced and transversely aligned lines 63, 63'. The cutting lines 63, 63' are spaced lengthwise of the blank a distance from the hinge score line 20 which equals, substantially, the distance between hinge score line 14 and the terminal edge 30 of the blank. The length of the cutting lines 63, 63' is somewhat less than the maximum dimension of the tab elements 52, 52' in the direction transversely of the blank 12. The cutting lines 63, 63' terminate at opposite ends at relatively short, transversely spaced cutting lines 64, 65 and 64', 65' which have their innermost end portions in diverging relation in the direction of the remote end of the blank and their outermost end portions in spaced outwardly diverging relation in the direction of the adjacent end of the blank 12. The cutting lines 64, 65 and 64', 65' extend between the ends of the cutting lines 63, 63' and the ends of hinge score lines 66, 66' which are in spaced parallel relation with the cutting lines 63, 63' and have a lesser dimension transversely of the blank, which lengthwise dimension corresponds approximately to the dimension of hinge score lines 55, 55' for the male locking or latching tab elements 52, 52' in the panel 27. The end portions of each of the cutting lines 64, 65 and 64', 65' diverge in the direction of the lateral edges of the blank 12 and may extend slightly beyond the ends of the cutting lines 63, 63' and the hinge score lines 66, 66'. Between each pair of the lines 63, 66 and 63', 66' the cutting lines 64, 65 and 64', 65' form small wing members 67, 68 and 67', 68' which will bend sufficiently to permit insertion of the locking tab elements 52, 52' the maximum width of which exceeds the distance between the wing members 67, 68 and 67', 68' at their closest points.

Figure 5:
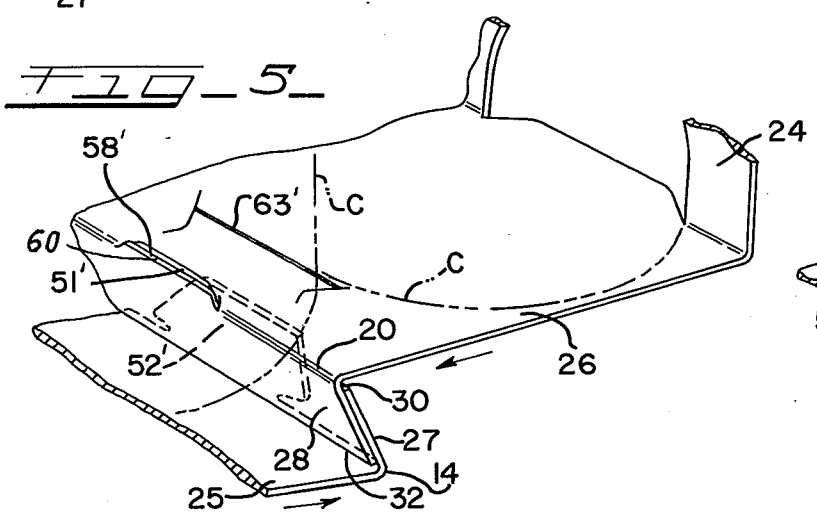
FIG. 5 is a view illustrating in perspective, the initial folding, locking and latching operations employed in securing the blank of FIG. 4 about a group of cans so as to form a tightly wrapped package.

The method of securing the cut and scored blank 12 on an assembly of cans so as to obtain a tightly wrapped package is illustrated in the drawings, particularly with respect to the interleaving of the end connecting panels 27, 28 and interengaging the locking and latching elements. The separating tabs 38, 38' in the top wall forming panel 22 are initially turned inwardly or downwardly and the panel 22 is positioned on the top of the can assembly with the tabs 38, 38' between the adjacent chime edges of each pair of cans. The sidewall forming panels 23, 24 are folded down on opposite sides of the assembly and the bottom wall forming panels 25, 26 are folded toward each other with the panel 26 preceding the panel 25 and with the end panels 27, 28 being hinged toward interleaving relation as shown in FIG. 5 so as to engage the primary locking tabs 51, 51' in the cooperating locking apertures 60, 60'(FIGS. 1, 2, 3, 5 and 6). The terminal edge 30 is guided into engagement at the hinge line 20 as the panel 28 is swung about the hinge 20 toward the adjoining portion of panel section 26 so as to interleave the panels 27 and 28, the terminal edge 32 of panel 28 engaging or moving into position adjacent the hinge 14. While the panels 27 and 28 are being hinged toward the panel section 26, the latching tabs 52, 52' are guided into the slits formed by the separation of the material along the cutting lines 63, 63', the small panels 70 and 70' bending sufficiently to accommodate the entry of the latching tabs 52, 52'. The latching tabs 52, 52' may remain in a vertical plane as shown and serve as separators for the chime edges of the paired cans. The interfolding of the panels 27 and 28 with the edge 30 of the panel 27 engaging at the inside area of hinge 20 as a fulcrum results in the drawing of the bottom wall panels 25 and 26 toward each other, as indicated by the arrows in FIGS. 5 and 6, and also results in drawing the top and side wall panels tightly about the assembly of cans due to the relative dimensions of the panels and the cans, without the need for any exterior pressure on the sidewall panel areas or in the plane of the bottom wall. The engagement of the primary locking tab elements 51, 51' in the apertures 60 serves to properly align the panels 25, 26 for engagement of the secondary locking and latching elements and to correct any misalignment which might occur in the folding of the wall panels into position. The interfolded or interleaved end panels 27, 28 are folded into the plane of the bottom wall panels and locked in position in snug relation beneath the one row of cans. While in the form shown, the closure panels are positioned on the bottom of the can assembly, it is contemplated that the that the blank may be cut and scored, so that the closure panels are disposed on the top of the can assembly or on a sidewall. It is also contemplated that high speed machinery will be designed for forming the packages which will be of less complexity than machinery heretofore provided for forming tightly wrapped packages with wrap-around type can and bottle wrapping blanks, which have been previously designed.

What is claimed is:

1. A package comprising an assembly of articles having the general form of beverage containers arranged in double row relation and enclosed in a tubular wrapper formed of a foldable sheet of paperboard or similar material of generally rectangular configuration which is divided into wall forming panels and wrapped about three sides of the article assembly and with end sections overlapped and secured in tight relation on the fourth side, said wrapper end sections including hinged terminal end portions forming latching and locking panels which are folded into interleaved relation and secured in the plane of the wall forming panels of said fourth side, each said locking and latching panel being sandwiched between the associated locking and latching panel and portions of the wall panel adjoining the hinged connection therewith, with terminal edge portions of at least one of said latching and locking panels being disposed in pressure engagement at the hinge line of the associated interleaved panel, so as to draw the associated fourth wall forming panels toward each other, the innermost one of said locking and latching panels having locking and latching elements which are spaced relative to each other in the direction normal to the hinge line of said locking and latching panels and which are interengaged with cooperating spaced locking and latching elements in adjacent innermost panel portions which overlie said innermost locking and latching panels, so as to hold said wall panels in tightly drawn relation about said article assembly.

2. A package as set forth in claim 1 wherein the innermost one of said locking and latching panels has a male cooperating element on the terminal edge thereof engaged in a cooperating female locking element at the hinge line of the outermost one of said locking and latching panels whereby said panels are held in alignment with each other.

3. A package as set forth in claim 1 wherein the innermost one of said locking and latching panels has male locking and latching elements arranged in paired and spaced relation relative to the terminal and hinged edges thereof and the panel to which the outermost one of said locking and latching panels is hinged has cooperating female locking elements cut therein in which said male locking and latching elements are seated.

4. A package as set forth in claim 3 wherein said innermost one of said locking and latching panels has a male latching element adjacent the hinge area thereof which extends through a cooperating female latching element in the overlying innermost wall panel and in a plane normal to said innermost wall panel thereby forming a separator between opposed portions of a pair of the articles.

5. A wrapper for packaging cans or similar articles which is characterized by a wraparound style blank of paperboard, or other suitable sheet material, which is cut and scored to divide it into wall forming panels adapted to be wrapped about a row of cans, or the like, so as to form an open ended tubular carton, with the blank having hinged terminal end panels in the form of narrow strips which are interleaved and secured in coplanar relation with adjoining panel portions so as to cooperate in forming one of the carton walls, said end panels being dimensioned so that they may be seated by a hinging movement which draws the adjoining panel portions toward each other and the carton walls into tight wrap formation, one of said end panels having primary locking tabs on the terminal edge and secondary locking tabs at the hinge line which are engaged, upon said hinging movement, in cooperating locking apertures disposed at the hinge line of the other end panel and spaced therefrom, said secondary locking tabs being cut from the material adjacent the hinge line of said one end panel and the cooperating locking apertures being cut in the material of the wall panel to which the other end panel is hingedly connected and being spaced relative to the connecting hinge line.

* * * * *